United States Patent [19]

Schmidt

[11] 4,059,865

[45] Nov. 29, 1977

[54] SHOE CLEANING MAT

[75] Inventor: Achim D. Schmidt, Hohenlockstedt, Holstein, Germany

[73] Assignee: Alveru S. A., Fribourg, Switzerland

[21] Appl. No.: 701,023

[22] Filed: June 30, 1976

[30] Foreign Application Priority Data

July 2, 1975 Germany ..... 7520999[U]

[51] Int. Cl.[2] ..... A46B 7/04; A47L 23/26

[52] U.S. Cl. ..... 15/161; 15/202; 15/217; 428/88; 428/116

[58] Field of Search ..... 15/112, 161, 194, 202, 15/215–217; 74/563; 272/56.5 SS; 273/195 A; 428/15, 17, 33, 89; D6/209

[56] References Cited

U.S. PATENT DOCUMENTS

| | | | |
|---|---|---|---|
| 977,789 | 12/1910 | Donovan | 15/217 |
| 1,742,192 | 1/1930 | Bayer | 15/194 |
| 2,809,909 | 10/1957 | Chatanay | 428/88 X |
| 2,989,766 | 6/1961 | Hoag | 15/161 |
| 3,467,391 | 9/1969 | Elesh | 15/217 X |

FOREIGN PATENT DOCUMENTS

| | | | |
|---|---|---|---|
| 128,770 | 6/1932 | Austria | 15/112 |
| 1,141,303 | 3/1957 | France | 15/202 |
| 747,500 | 4/1956 | United Kingdom | 15/112 |

*Primary Examiner*—Daniel Blum
*Attorney, Agent, or Firm*—Walter Becker

[57] ABSTRACT

Brush bodies are held in recesses between webs for cleaning of a shoe by way of a foot mat of rubber, synthetic material or metal and the brushes project over the webs of the grate-formed mat. The brush bodies are insertable in the mat to be easily replaced when the brushes are worn whereby the wear on the basic body of the mat becomes reduced since the webs are used only for support and no longer for the cleaning function.

14 Claims, 2 Drawing Figures

SHOE CLEANING MAT

The innovation concerns a device for cleaning shoe gear in the configuration of traversible mat of rubber, synthetic material or metal, providing recesses or depressions arranged between grate-formed webs.

With such mats which are placed in the region of entry doors of buildings, preferably in recesses of the floor, there are to be removed or stripped away dirt or contamination adhering to the shoe gear. The mat webs which simultaneously must take up the entire loading are subjected accordingly to a considerable wear, otherwise the cleaning effect thereof is extremely nominal, especially with respect to dirt or parts thereof which as the consequence of the composition thereof, the moisture thereof or for other reasons, adhere securely to the soles, since this dirt resists the movement between the shoes and the webs of the mat during movement or walking on the mat.

The object of the innovation is now to improve the effectiveness of the device upon the shoe gear by way of arrangement of brushes projecting over the webs (walking or traversing surface).

Inventively, this object becomes resolved with brush bodies which are held in the recesses between the webs and having brushes thereof projecting over the webs.

The innovative arrangement of the brushes involves not being installed directly in the material of the mat but rather in brush bodies which are insertable in the mat thereby offering production or finishing of the brushes in a cost advantageous manner on the one hand and accordingly on the other hand also still providing for the device the advantage that worn brushes can become replaced easily and the wear of the mat base body becomes considerably reduced since the webs still only have a supporting function but no cleaning function anymore.

In a preferred embodiment of the innovation, there are projections provided on the walls of the recesses which can be multi-cornered or round which engage over or into the brush body. In this manner, the brush bodies are held so rigidly in the mat that the same cannot become lost during cleaning and/or bending of the mat and upon wearing away of the brushes, the same can still be easily interchanged. The recesses of the mat can be closed at the bottom or floor or can be provided with perforations and the brush bodies can be rings of circular form or angular or cornered configuration. The dirt brushed off from the shoe gear falls through the perforations or breakthroughs and ring openings in the brush bodies and the dirt becomes caught in the bedding of the mat out of which the dirt can become removed from time to time.

The cleaning effect of the innovative device can be adapted or matched to the particular requirements with the selection of the brush stiffness, brush elasticity and brush return-setting force, as well as the length of the projection of the bristles or brushes over the walking or traversing surface of the mat and the distribution thereof over the mat surface. Thereby, it has proved especially valuable to arrange the bristles or brushes in the brush bodies so that the bristles project at an incline as to the upper surface of the mat and extend therefrom whereby the bristles or brushes develop the greatest cleaning effect during the slightest wear. By way of the incline position of the bristles or brushes, the same brush or sweep because of the elasticity thereof both during stepping thereon and also by way of the return-setting effect automatically during lifting of the shoe soles therefrom which means without the otherwise conventional to and fro cleaning movement of the shoe gear.

Certain sample embodiments of the innovation become described with respect to the drawings. These and other objects and advantages of the invention will appear more clearly from the following specification in connection with the accompanying drawings, in which.

Figure 1:
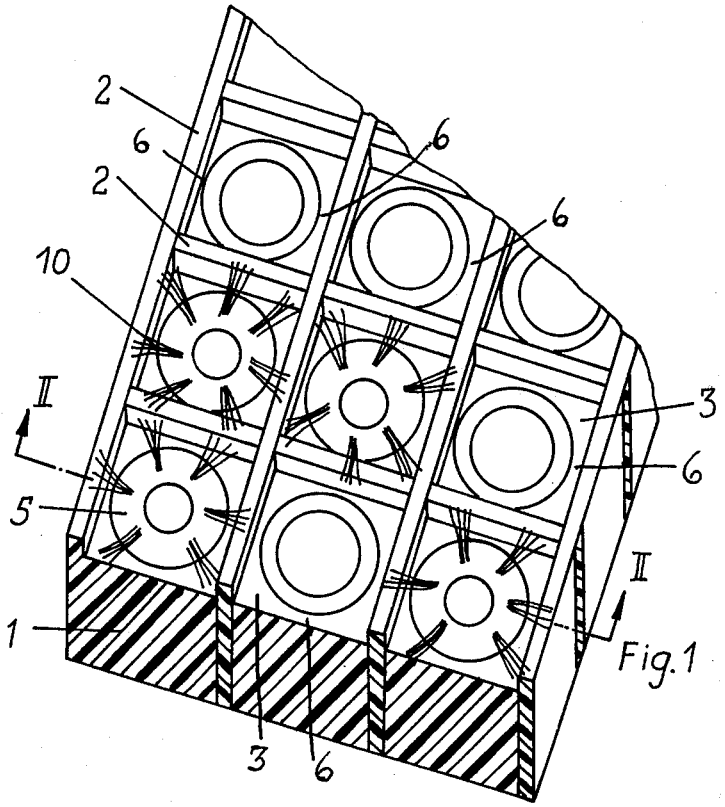
FIG. 1 is a perspective section view of a device for cleaning the shoe gear.
Figure 2:
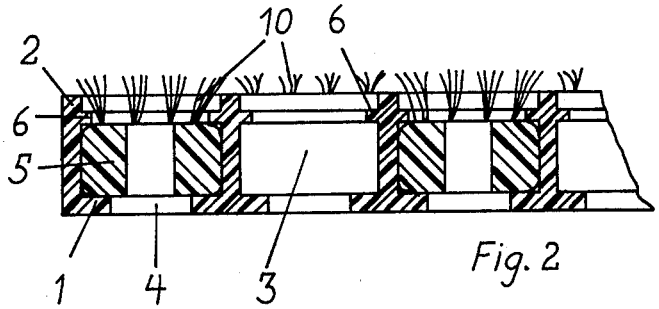
FIG. 2 is a section taken longitudinally along line II—II of FIG. 1.
Figure 3:
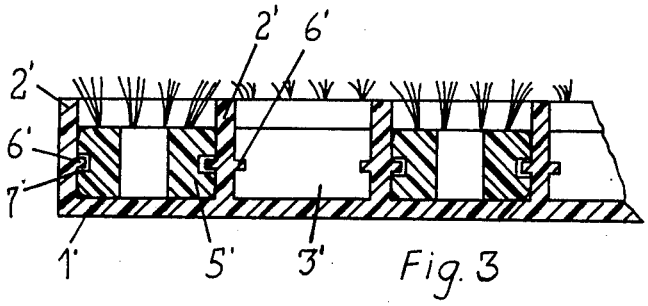
FIG. 3 is a section corresponding to that of FIG. 2 through a different embodiment of the innovation.

Referring now to the drawings in detail, the treading-off or stepping-off device embodied as a mat consists of a base body 1, preferably of rubber or synthetic material with which a multiplicity of round depressions or recesses 3 of which the bottom provides passages or breakthroughs 4 (FIGS. 1 and 2) or of which the bottoms are closed (FIGS. 3 and 4) there are annular or ring-formed brush bodies 5 inserted therein. On the walls of the recesses, there are projections 6 or 6' provided which engage over the brush bodies 5 (FIG. 2) or in a groove 7 extending around the outer periphery thereof (FIG. 3) into the brush bodies 5' and thereby holding the brush bodies removably in the recess 3'. The bristles or brushes 10 anchored in the brush bodies 5, 5' project at an incline over the upper surface of the base body 1, 1' so that the brushes carry out the cleaning effect upon shoe gear during stepping or walking upon the mat while the weight of the individual stepping or walking on the mat is carried by the webs 2, 2'.

Figure 4:
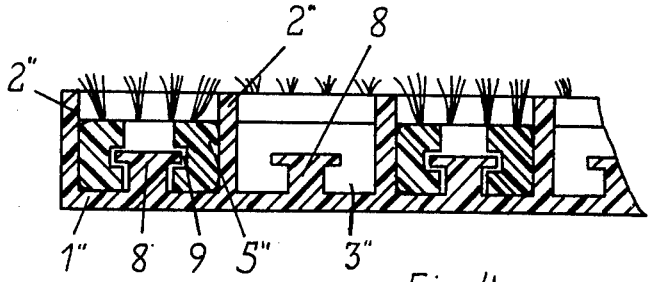
FIG. 4 is a section similar to that of FIG. 2 through a further innovative device for cleaning of shoe gear.

With the embodiment according to FIG. 4, it is to be noted that the closed bottom of the recess 3'' is provided with a mushroom-formed stud or projection 8 which cooperates with an undercut or inner groove 9 of the brush body 5'' for holding the brush body 5'' in the recess 3''.

There is possible also to produce the base body 1 including the projections 6 or 8 of metal. The holding of the brushes is likewise possible in such a base body 1 in the described manner when the brush bodies 5 consist of corresponding elastic work material.

It is, of course, to be understood that the present invention is, by no means, limited to the specific showing in the drawings but also comprises any modification within the scope of the appended claims.

What I claim is:

1. A device for cleaning of shoe gear in the form of a traversible mat having a basic body with an upper surface of suitable solid material providing recesses between webs arranged in a grate form, comprising: annular, removable brush bodies held in the recesses, and stiff, resilient bristles fixed in and projecting from the bodies over the webs, said bristles being arranged as rings around the peripheries of said brush bodies to project outwardly at an incline to the vertical from the upper surface of said brush body and over the webs of said basic body of the mat.

2. A device according to claim 1, wherein the recesses are multi-cornered.

3. A device according to claim 1, wherein the recesses are round.

4. A device according to claim 1, wherein wall means form the recesses, and projections are provided on said wall means, said projections extending over said brush bodies.

5. A device according to claim 1, wherein grooves are provided in said brush bodies, wall means form the recesses, and projections are provided on said wall means, said projections extending into the grooves.

6. A device according to claim 1, wherein circular-formed rings are formed by said brush bodies.

7. A device according to claim 1, wherein angular configurations are formed by said brush bodies.

8. A device according to claim 1, wherein bottoms are provided with the recesses with perforations therethrough.

9. A device according to claim 1, wherein closed bottoms are provided with the recesses.

10. A cleaning device in the form of a traversible mat for cleaning footwear comprising a base body molded of resilient material having a plurality of rows of similar recesses opening on one surface with webs spacing and surrounding said recesses to form a grate structure, removable brush bodies of molded resilient material fitting into said recesses of less depth than said recesses, each of said brush bodies having a peripheral wall surrounding a central aperture with a row of stiff, elastic bristles around the outer periphery extending outwardly at an angle to the central axis of said body beyond the outer edge of said body and over the edges of the webs bordering the recess, each brush body resiliently engaging in its recess to retain said brush body in said recess.

11. A cleaning device in the form of a traversible mat for cleaning footwear comprising a base body molded of resilient material formed with a plurality of intersecting webs to provide rows of similar recesses bordered by said webs to form a grate structure, removable brush bodies fitting into said recesses, said base body and brush bodies interengaging to retain said brush bodies in said recesses, each of said brush bodies having a peripheral wall surrounding a central aperture with a row of stiff, elastic bristles fixed in said brush body around the periphery and inclined outwardly at an angle to the central axis of said brush body and extending beyond the periphery of said brush body and over the edges of the adjacent webs of said base body.

12. A device as claimed in claim 11, in which each brush body is formed of molded material, and said bristles are molded in said brush body at an angle to the central axis of said brush body, said bristles being sufficiently stiff to maintain said angle to the central axis.

13. A device as claimed in claim 11, in which the walls of the recesses in said base body are formed with portions overlying said brush bodies, said recesses resiliently receiving said brush bodies to retain said brush bodies in said recesses.

14. A device as claimed in claim 11, in which each brush body is molded in the form of a ring, with the stiff bristles molded in said ring at an angle to the central axis of said ring.

* * * * *